US010597212B2

(12) United States Patent
Evans

(10) Patent No.: US 10,597,212 B2
(45) Date of Patent: Mar. 24, 2020

(54) FLUID-DISPENSING BAG HOLDER

(71) Applicant: Karten Products LLC, Fayetteville, NY (US)

(72) Inventor: Jeffrey R. Evans, Fayetteville, NY (US)

(73) Assignee: Karten Products LLC, Fayetteville, NY (US)

( * ) Notice: Subject to any disclaimer, the term of this patent is extended or adjusted under 35 U.S.C. 154(b) by 0 days.

(21) Appl. No.: 16/113,178

(22) Filed: Aug. 27, 2018

(65) Prior Publication Data

US 2020/0062478 A1 Feb. 27, 2020

(51) Int. Cl.
*B65D 77/02* (2006.01)
*B65D 77/06* (2006.01)

(52) U.S. Cl.
CPC ..... *B65D 77/065* (2013.01)

(58) Field of Classification Search
CPC .... B65D 77/06; B65D 77/062; B65D 77/065; B67D 2001/0827
See application file for complete search history.

(56) References Cited

U.S. PATENT DOCUMENTS 444,659 A * 1/1891 Brown ..... B65D 77/065
1,614,054 A 1/1927 Wolkenhauer
2,161,323 A 6/1939 Stephenson
3,239,104 A * 3/1966 Scholle ..... B67B 7/26 222/514
3,371,824 A 3/1968 Goss
3,453,033 A * 7/1969 Goss ..... B67D 3/00 220/495.05
3,696,969 A 10/1972 De Van et al.
4,105,139 A 8/1978 Scholle
4,771,918 A * 9/1988 Haggart ..... B65D 83/0061 222/105
5,462,168 A 10/1995 Oberhelman et al.
5,660,307 A * 8/1997 Schroeder ..... B67D 1/00 222/108
7,137,533 B1 11/2006 Heath
8,800,814 B2 8/2014 Braun et al.
9,085,398 B1 * 7/2015 Fellin ..... B65D 77/044
9,200,748 B1 12/2015 Goyarola et al.
9,561,517 B2 2/2017 Wertheim et al.
2007/0012722 A1 * 1/2007 Evangelista ..... B65D 11/06 222/105
2007/0045339 A1 * 3/2007 Manion ..... B65D 77/065 222/95

(Continued)

*Primary Examiner* — J C Jacyna
(74) *Attorney, Agent, or Firm* — Brown & Michaels, PC

(57) ABSTRACT

A fluid-dispensing bag holder includes a first housing member and a second housing member. The first housing member has a first edge with a first concavity, the second housing member has a second edge with a second concavity, and the first housing member and the second housing member are configured to be positioned in an open position and a closed position. The closed position includes the first housing member mated with the second housing member to define an internal space between the first housing member and the second housing member, and such that the first edge mates with the second edge and the first concavity aligns with the second concavity to define a spout opening through the first housing member and the second housing member into the internal space.

18 Claims, 10 Drawing Sheets

(56) References Cited

U.S. PATENT DOCUMENTS

| | | | | |
|---|---|---|---|---|
| 2008/0121662 | A1* | 5/2008 | Gehl | B67D 1/108 222/214 |
| 2014/0252032 | A1* | 9/2014 | Corbett | B65D 25/18 222/105 |
| 2017/0088411 | A1* | 3/2017 | Oostveen | B65D 77/065 |
| 2019/0055114 | A1* | 2/2019 | Bell | B67D 1/0462 |

* cited by examiner

FLUID-DISPENSING BAG HOLDER

FIELD OF THE INVENTION

The present invention generally relates to fluid dispensers, and more specifically, to a fluid-dispensing bag holder to hold a wine-dispensing or other fluid-dispensing bag.

DESCRIPTION OF RELATED ART

Wine is an example of a fluid commonly packaged and sold in boxed bags. The boxes, typically made of some sort of cardboard, each provide support for a bag, typically made of plastic, that directly contains the wine. FIG. 1 shows an example of a conventional boxed bag of wine 1. The boxed bag of wine 1 includes a wine box 2 containing a wine bag 3. The wine bag 3 has a hard spout 4 from which the wine can be dispensed. To mount the spout 4 in place with respect to the wine box 2, a spout hole 5 through a wall 6 in the wine box 2 can be enlarged by folding out one or more flaps, such as first flap 7 and second flap 7', so that the spout 4, including a first retaining flange 8 and/or a second retaining flange 9, can fit through the spout hole 5. The spout 4 can be positioned in the spout hole 5 so that the first flap 7 and the second flap 7' can be closed around the spout 4 and inserted between the first retaining flange 8 and the second flange 9. FIG. 2 illustrates the conventional boxed bag of wine 1 with the spout 4 mounted in place relative to the wine box 2. In other words, the spout 4 is positioned in the spout hole 5 and the first flap 7 and the second flap 7' are closed around the spout 4, with the first flap 7 and the second flap 7' between the first retaining flange 8 and the second retaining flange 9. The wine box 2 provides necessary support and protection for the flimsy and puncturable wine bag 3, but the cardboard box 2 is disposable and has limits regarding its durability and structural integrity. The cardboard material degrades quickly when exposed to water or other fluid, for example. The flaps 7, 7' intended to hold the spout 4 in the spout hole 5 also easily tear or fail to provide the structural strength necessary to hold the spout 4 in place. Manipulation of the spout 4, for example, to pour wine, can cause the flaps 7, 7' to bend and the spout 4 to pull out of the spout hole 5 or push into the wine box 2.

SUMMARY OF THE INVENTION

A reusable fluid-dispensing bag holder is disclosed that improves upon the durability and structural strength of conventional wine boxes, and enables convenient storage of the wine box on a vertical surface, such as the side of a refrigerator, cabinet, or wall.

In an embodiment, a fluid-dispensing bag holder includes a first housing member and a second housing member. The first housing member has a first edge with a first concavity, the second housing member has a second edge with a second concavity, and the first housing member and the second housing member are configured to be positioned in an open position and a closed position. The closed position includes the first housing member mated with the second housing member to define an internal space between the first housing member and the second housing member, and such that the first edge mates with the second edge and the first concavity aligns with the second concavity to define a spout opening through the first housing member and the second housing member into the internal space.

In another embodiment, a fluid-dispensing bag holder includes a first housing member, a second housing member, a dispenser opening, and a fastening element. The dispenser opening is defined through one or more of the first housing member and the second housing member into the internal cavity. The first housing member and the second housing member are movable between an open position and a closed position, the first housing member and the second housing member defining an internal cavity in the closed position. The fastening element is on at least one of the first housing member and the second housing member to secure the first housing member to the second housing member, the fastening element including a first slot on the first housing member, and a first pin on the second housing member, the first pin configured to be received by the first slot, the first slot having a first length and a second length, the first length and the second length each extending at a nonparallel angle to each other.

DETAILED DESCRIPTION OF THE INVENTION

Figure 1:
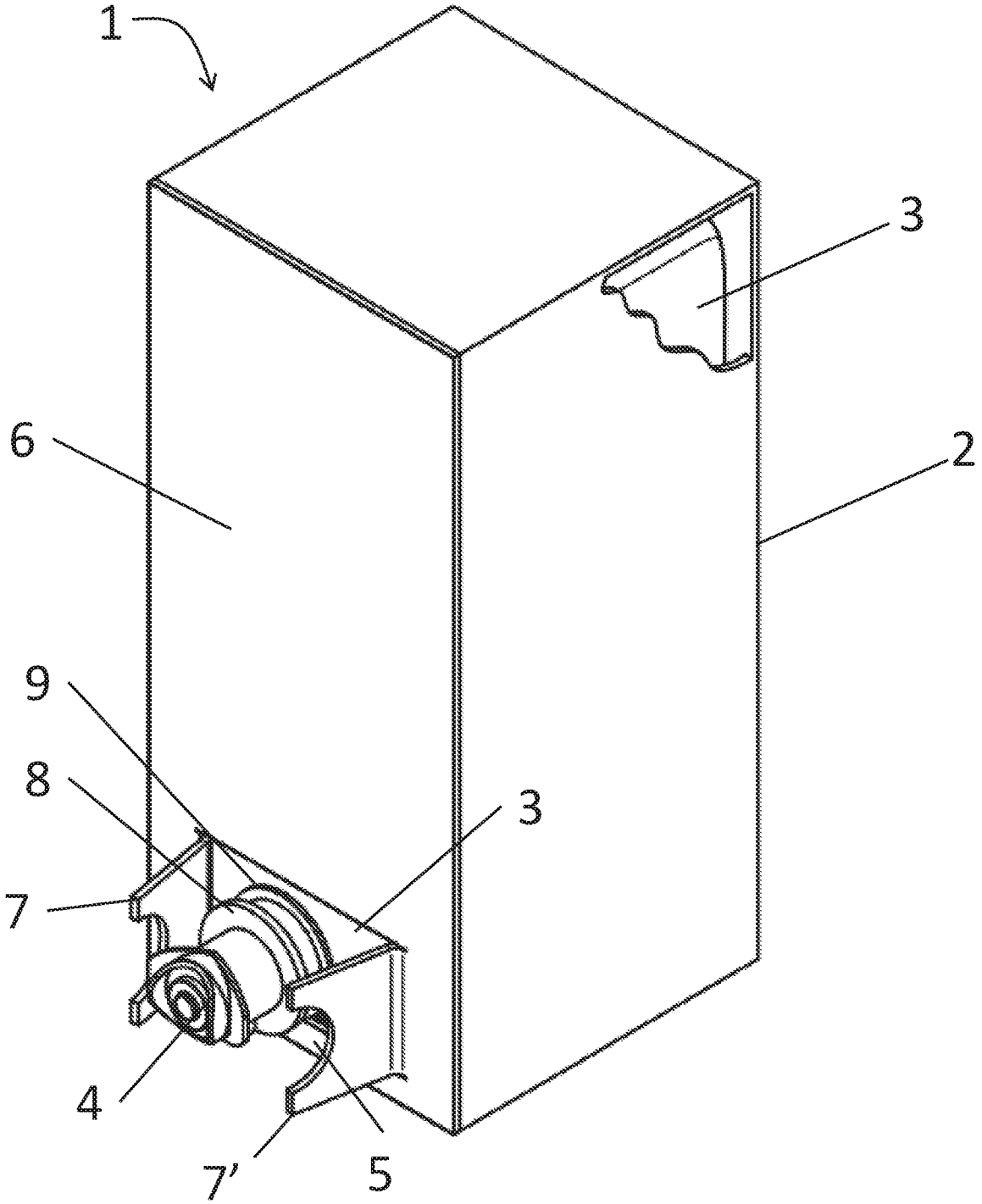
Fig. 1 Prior Art
FIG. 1 shows a perspective view of the conventional boxed bag of wine 1 with the spout 4 unmounted.
Figure 2:
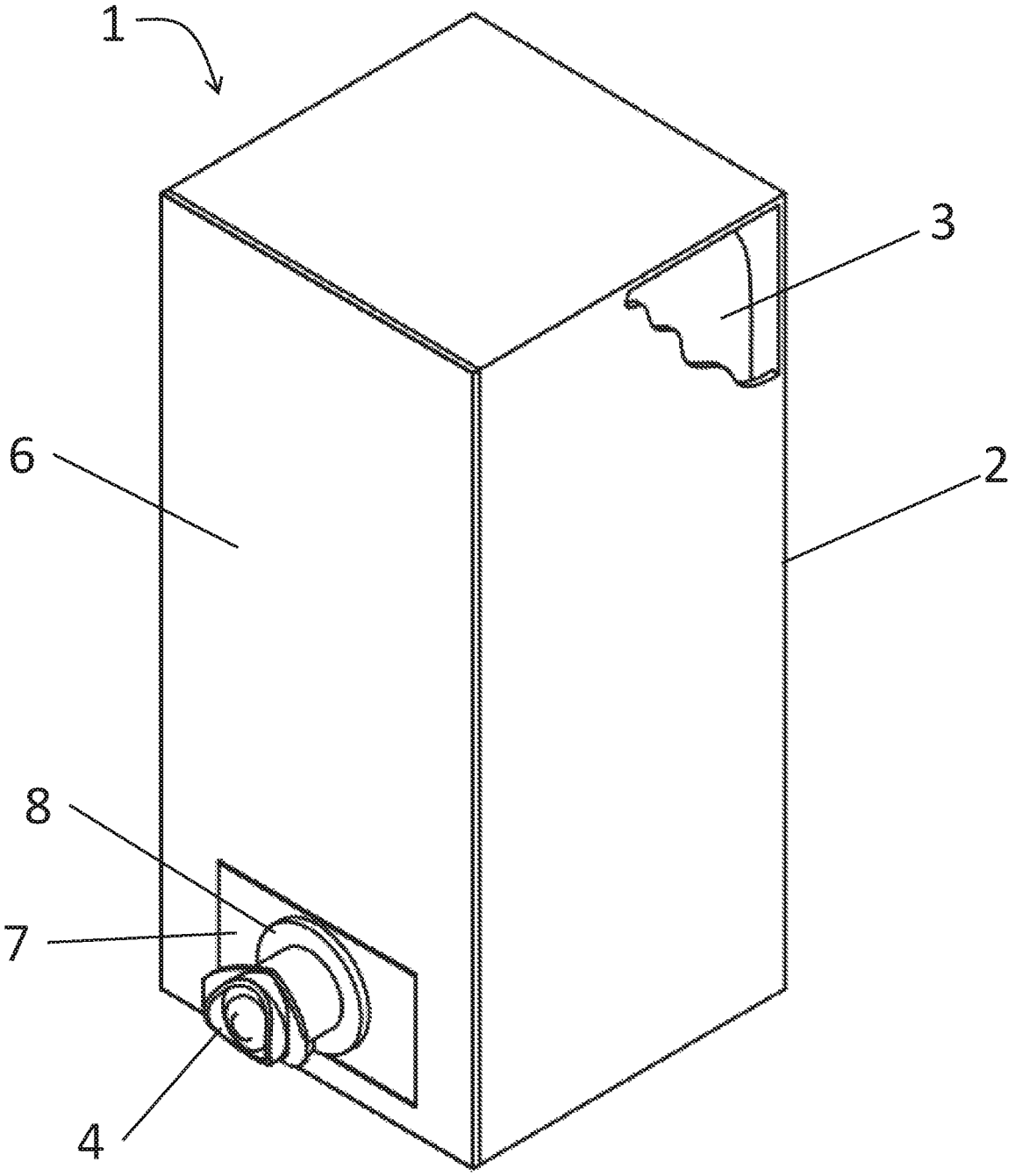
Fig. 2 Prior Art
FIG. 2 shows a perspective view of the conventional boxed bag of wine 1 of FIG. 1, with the spout 4 mounted in place relative to the wine box 2.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

The terminology used herein is for the purpose of describing particular example embodiments only and is not intended to be limiting. As used herein, the singular forms "a", "an", and "the" may be intended to include the plural forms as well, unless the context clearly indicates otherwise.

The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terms "about" and "approximately", when used with a specific value, unless specified otherwise, shall mean any value within a range from the value given plus or minus 10 percent of the value given.

Figure 3:
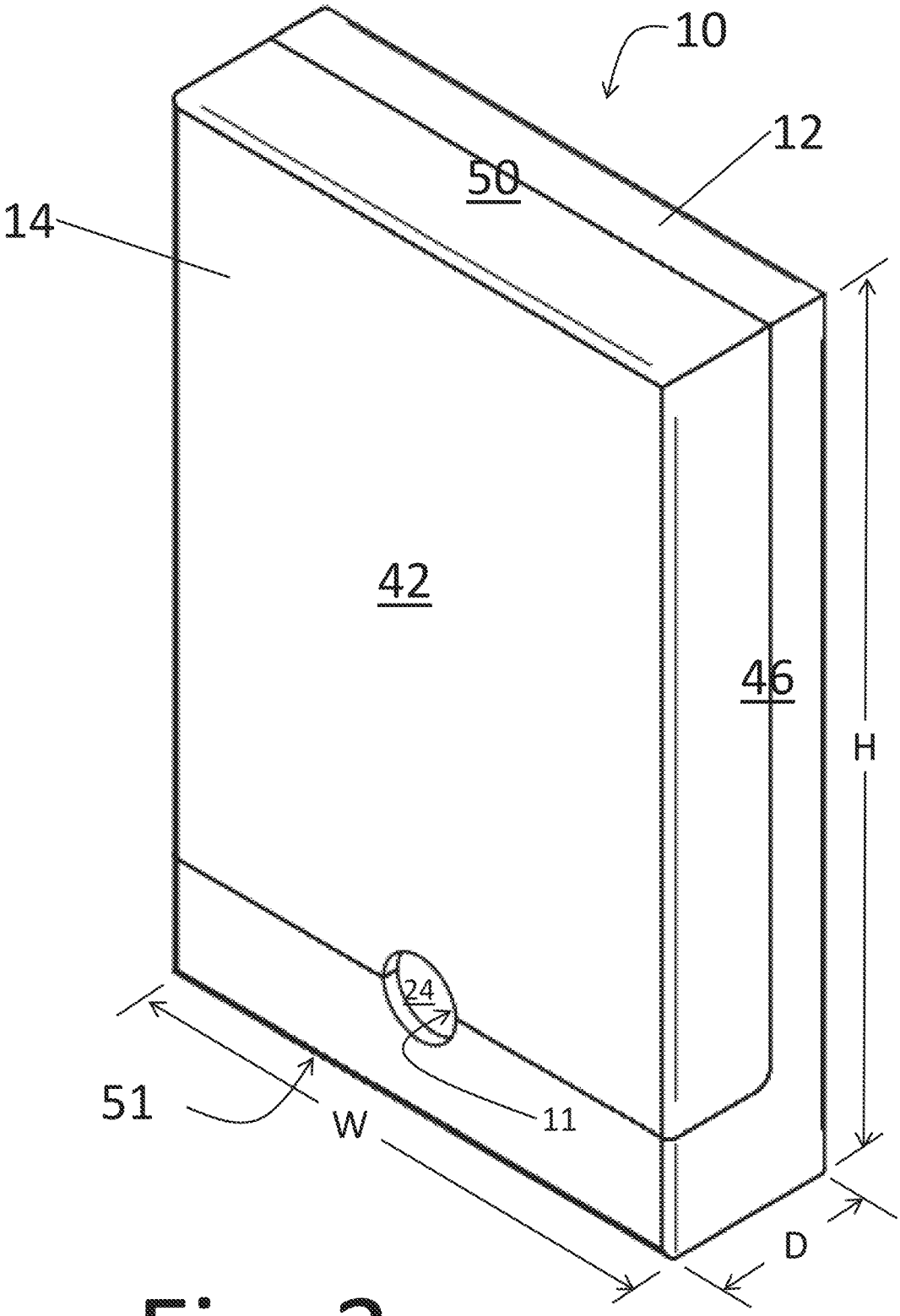
FIG. 3 shows a front perspective view of a fluid-dispensing bag holder, according to an embodiment of the present invention.
Figure 4:
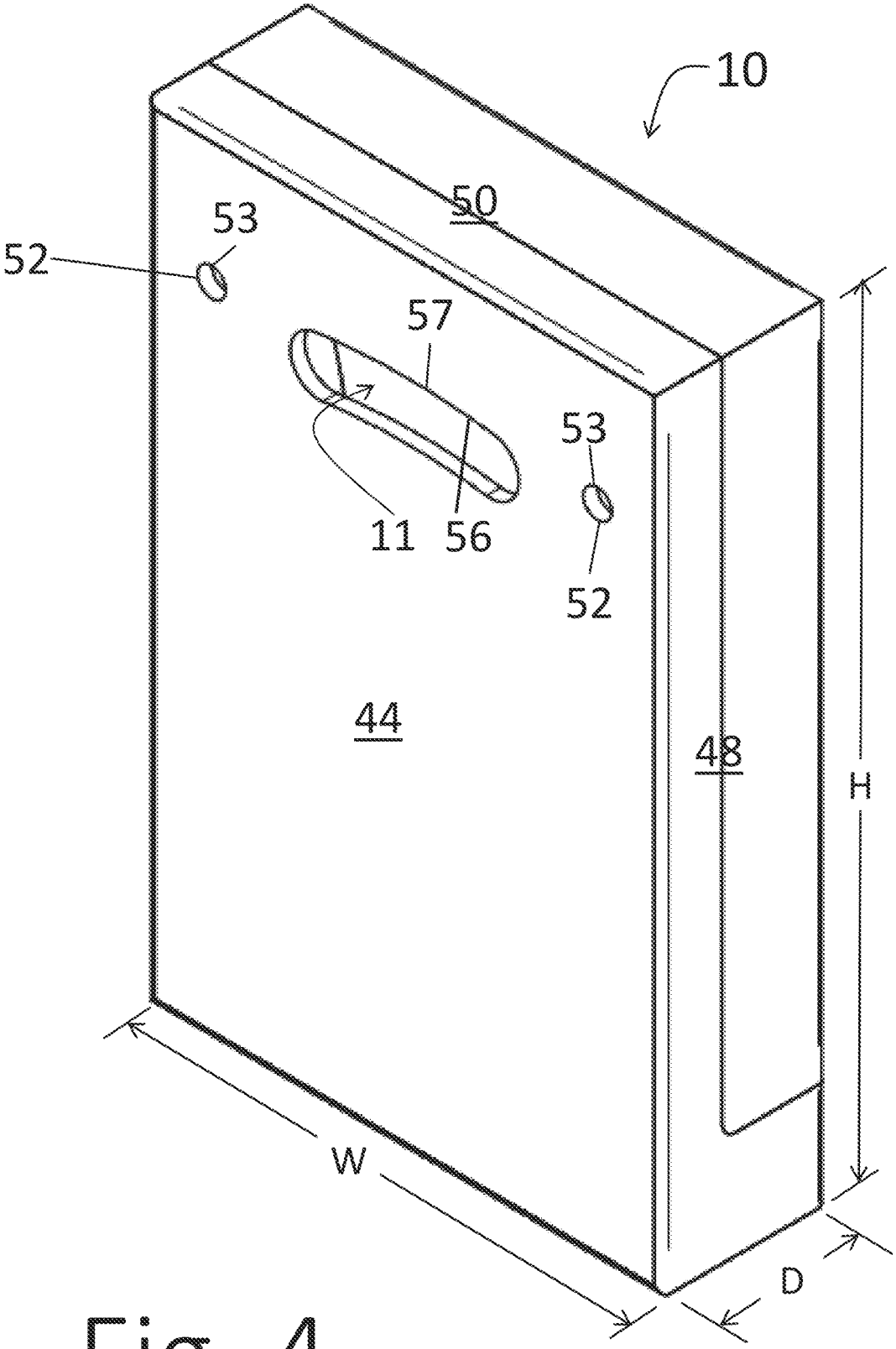
FIG. 4 shows a rear perspective view of the fluid-dispensing bag holder of FIG. 3.

As discussed above, a reusable fluid-dispensing bag holder is disclosed that can be used as a wine bag holder to improve upon the durability and structural strength of conventional wine boxes, as well as the aesthetic appearance of conventional wine boxes. FIG. 3 shows a front perspective view of a fluid-dispensing bag holder 10, according to an embodiment of the present invention. FIG. 4 shows a rear perspective view of the fluid-dispensing bag holder 10. Referring to FIGS. 3 and 4, the fluid-dispensing bag holder 10 includes a first housing member 12 and a second housing member 14. The first housing member 12 and the second housing member 14 are configured to be mated into a closed position, as shown in FIGS. 3 and 4. In this closed position, the fluid-dispensing bag holder 10 is generally shaped as a rectangular cuboid to match the rectangular or rectangular cuboid shape of a wine bag (not shown), which can be contained or supported in an internal space 11 of the fluid-dispensing bag holder 10 between the first housing member 12 and the second housing member 14. The first housing member 12 is shaped like a capital "L", and the second housing member 14 is shaped like a lower case "l", such that when they are mated, they form the desired shape of a rectangular cuboid. These depicted shapes are not intended to be limiting, however, as other shapes for the fluid-dispensing bag holder 10, such as a triangular prism, a tetrahedron, a sphere, a semi-sphere, or a disc, among others, could be suitable. The fluid-dispensing bag holder 10 can be shaped to match the shape of any wine bag, or the shape of another fluid-dispensing bag.

Figure 5:
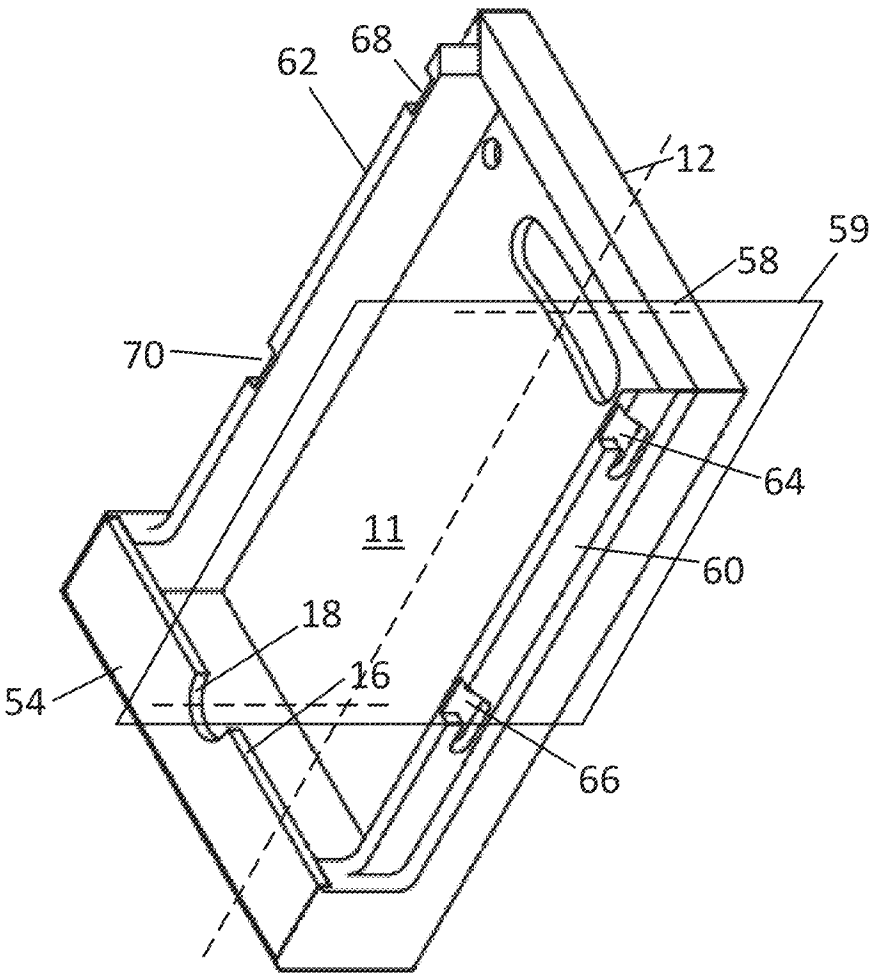
FIG. 5 shows a front perspective view of a first housing member of the fluid-dispensing bag holder of FIG. 3 and a rear perspective view of a second housing member of the fluid-dispensing bag holder of FIG. 3.
Figure 5:
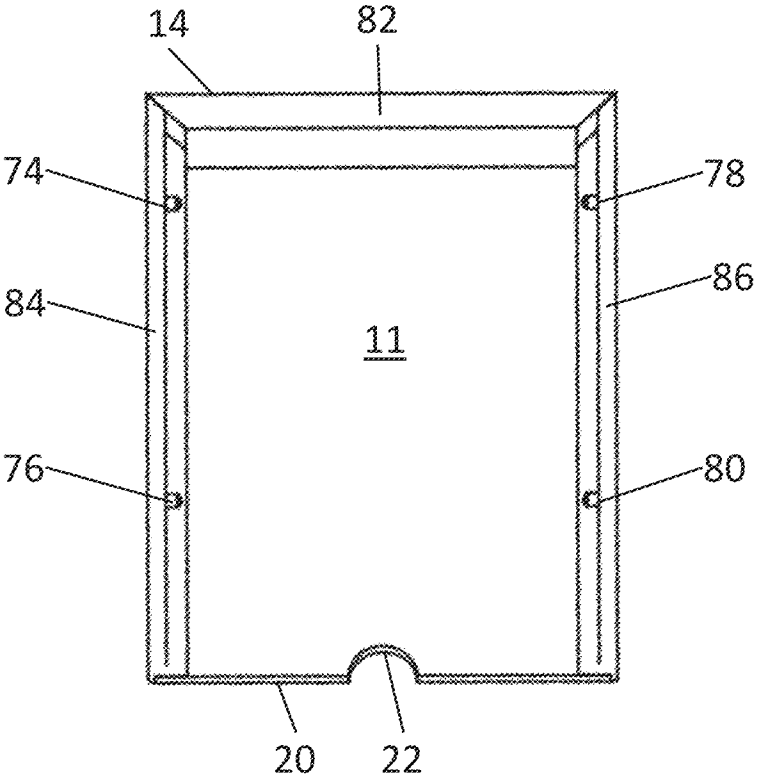
Figure 6:
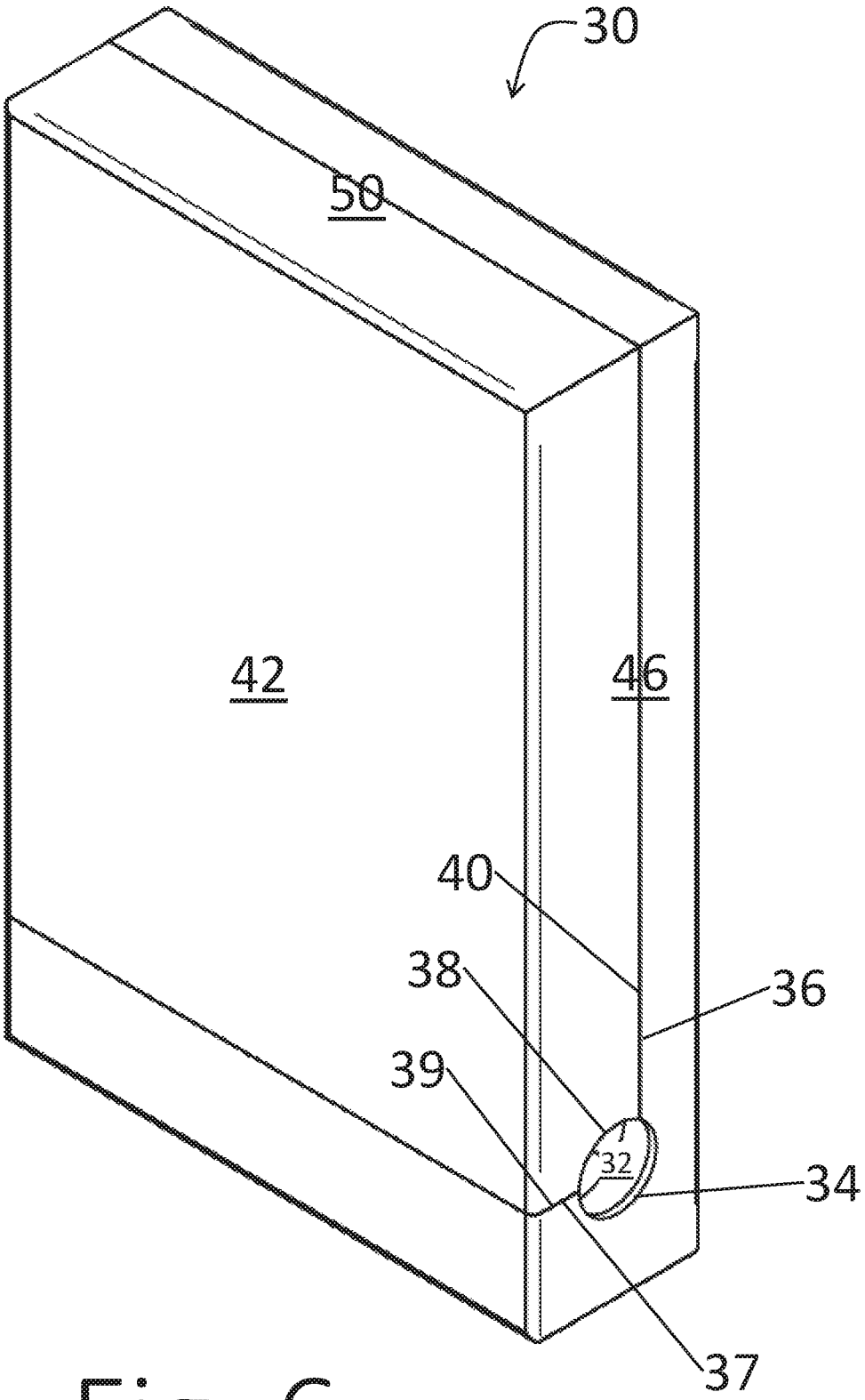
FIG. 6 shows a front perspective view of a fluid-dispensing bag holder according to an embodiment of the invention.

FIG. 5 shows a front perspective view of the first housing member 12 and a rear perspective view of the second housing member 14. In other words, FIG. 5 shows the fluid-dispensing bag holder 10 in an open position with the second housing member 14 separated from the first housing member 12, such that the internal space 11 of the fluid-dispensing bag holder 10 can be seen, as well as the interior surfaces of the first housing member 12 and the second housing member 14. Referring to FIGS. 3-5, the first housing member 12 has a first edge 16 with a first concavity 18, and the second housing member 14 has a second edge 20 with a second cavity 22. When the second housing member 14 is mated with the first housing member 12 to close the fluid-dispensing bag holder 10, the first edge 16 mates with the second edge 20 and the first concavity 18 aligns with the second concavity 22 to define a spout opening 24 through the first housing member 12 and the second housing member 14 into the internal space 11. Any edges of the first housing member 12 and the second housing member 14 that mate in the closed position can have the first concavity 18 and the second concavity 22 to form the spout opening 24. For example, FIG. 6 shows an alternative embodiment—a fluid-dispensing bag holder 30 with a spout opening 32 created by a first concavity 34 on a third edge 36 and fourth edge 37 aligned with a second concavity 38 on a fifth edge 39 and sixth edge 40.

Referring again to FIGS. 3-5, the spout opening 24 has a diameter, and the diameter of the spout opening 24 is smaller than a diameter of a retaining flange on a wine bag spout, such that in the open position, a wine bag can be placed in the first housing member 12 and the wine bag spout can be positioned in the first concavity 18. The second housing member 14 can then be mated with the first housing member 12, closing the wine bag in the internal space 11 with the wine bag spout retaining flange outside the fluid-dispensing bag holder 10, locking the wine bag spout in the spout opening 24.

As the spout opening 24 can be defined by any mating edges of the first housing member 12 and the second housing member 14, the spout opening 24 can likewise be positioned through any exterior face of the fluid-dispensing bag holder 10. Referring to FIGS. 3 and 4, in the closed position, the fluid-dispensing bag holder 10 includes a width W, a depth D, and a height H. A first face 42 including a portion of the second housing member 14 and a portion of the first housing member 12, and a second face 44 on the first housing member 12, are defined by the width W and the height H. A third face 46 and a fourth face 48 are defined by the depth D and the height H, and a fifth face 50 and a sixth face 51 are defined by the width W and the depth D. The depth D is smaller than the width W and the height H, and the height H is greater than the width W and the depth D. The spout opening 24 is located through the first face 42. Because there are mating edges on each of the second face 44, the third face 46, the fourth face 48, and the fifth face 50, the spout opening 24 could also be located through any one of the second face 44, the third face 46, the fourth face 48, and the fifth face 50. In the embodiment depicted in FIG. 6, for example, the spout opening 32 extends through the third face 46.

Referring to FIGS. 3-5 (in particular, FIG. 4), the fluid-dispensing bag holder 10 can include at least one mounting element 52 to mount the fluid-dispensing bag holder 10 on a wall or other surface, or otherwise facilitate stabilizing the fluid-dispensing bag holder 10 in an upright position. The at least one mounting element 52 can be any now-known or future-developed mounting element, such as a hook, anchor, etc. Two mounting elements 52 are depicted in the figures and these mounting elements 52 are mounting openings. The mounting elements 52 can be located on any external face, though it is beneficial for the mounting elements 52 to be on a different face than the face having the spout opening 24, so that the spout opening 24 is accessible facing away from a wall or other surface to which the fluid-dispensing bag holder 10 is mounted. In the depicted embodiment, the mounting elements are located in the second face 44. The first housing member 12 has a first face portion 54 forming part of the first face 42, and has the second face 44. The first face portion 54, which has the first concavity 18, and the second face 44, which has the mounting elements 52, face opposite directions. To facilitate level mounting, the two mounting elements 52 can be positioned relative to each other so that a line tangential to a support point 53 of each mounting element 52 is parallel with the first edge 16 of the first housing member 12.

The fluid-dispensing bag holder 10 can also include a handle element 56 to facilitate manual operation, lifting, or transporting of the fluid-dispensing bag holder 10. The handle element 56 can include any now-known or future-developed handle, such as but not limited to, a leather strap affixed to the first or second housing member 12, 14, a metal pull affixed to the first or second housing member 12, 14, or the depicted handle opening 56 through the second face 44. The handle element 56 can be positioned so that a line tangential to the support point 53 of each mounting element 52 can also be tangential to a support point 57 of the handle element 56. This alignment of the support point of the handle element 56 with the support point of each mounting element facilitates use of the handle element as a further mounting element 52. The handle opening 56 is sized for gripping by an adult-sized human hand, and is larger than the mounting openings 52. To facilitate stable manipulation with the handle element 56, the handle element 56 can be positioned on a plane of symmetry 59 for the first housing member 12, along with the first concavity 18.

The fluid-dispensing bag holder 10 can include a fastening element to fasten together the first housing member 12 and the second housing member 14 in the closed position. The fastening element can include any appropriate now-known or future-developed fastener. Referring to the embodiment of FIG. 5, the first housing member 12 includes a first wall 58, a second wall 60 intersecting the first wall 58, and a third wall 62 intersecting the first wall 58. The third wall 62 is opposite the second wall 60, and the first wall 58, the second wall 60, and the third wall 62 encircle three sides of the internal space 11. The second wall 60 has a first slot 64 and a second slot 66, and the third wall has a third slot 68 and a fourth slot 70. These slots 64, 66, 68, 70 can receive pins 74, 76, 78, 80, respectively, in the second housing member 14. The second housing member 14 includes a first wall 82, a second wall 84 intersecting the first wall 82, and a third wall 86 intersecting the first wall 82. The third wall 86 is opposite the second wall 84, and the first wall 82, the second wall 84, and the third wall 86 encircle three sides of the internal space 11. The pins 74, 76 extend from the second wall 84, and the pins 78, 80 extend from the third wall 86. Each of the pins 74, 76, 78, 80 can extend parallel to the first face 42 and/or the first wall 82. As discussed above the pins 74, 76, 78, 80 can be received in slots 64, 66, 68, 70, respectively. The first slot 64 and the second slot 66 are spaced the same as a distance between the first pin 74 and the second pin 76, and the third slot 68 and the fourth slot 70 are spaced the same distance as a distance between the third pin 78 and the fourth pin 80.

Figure 7:
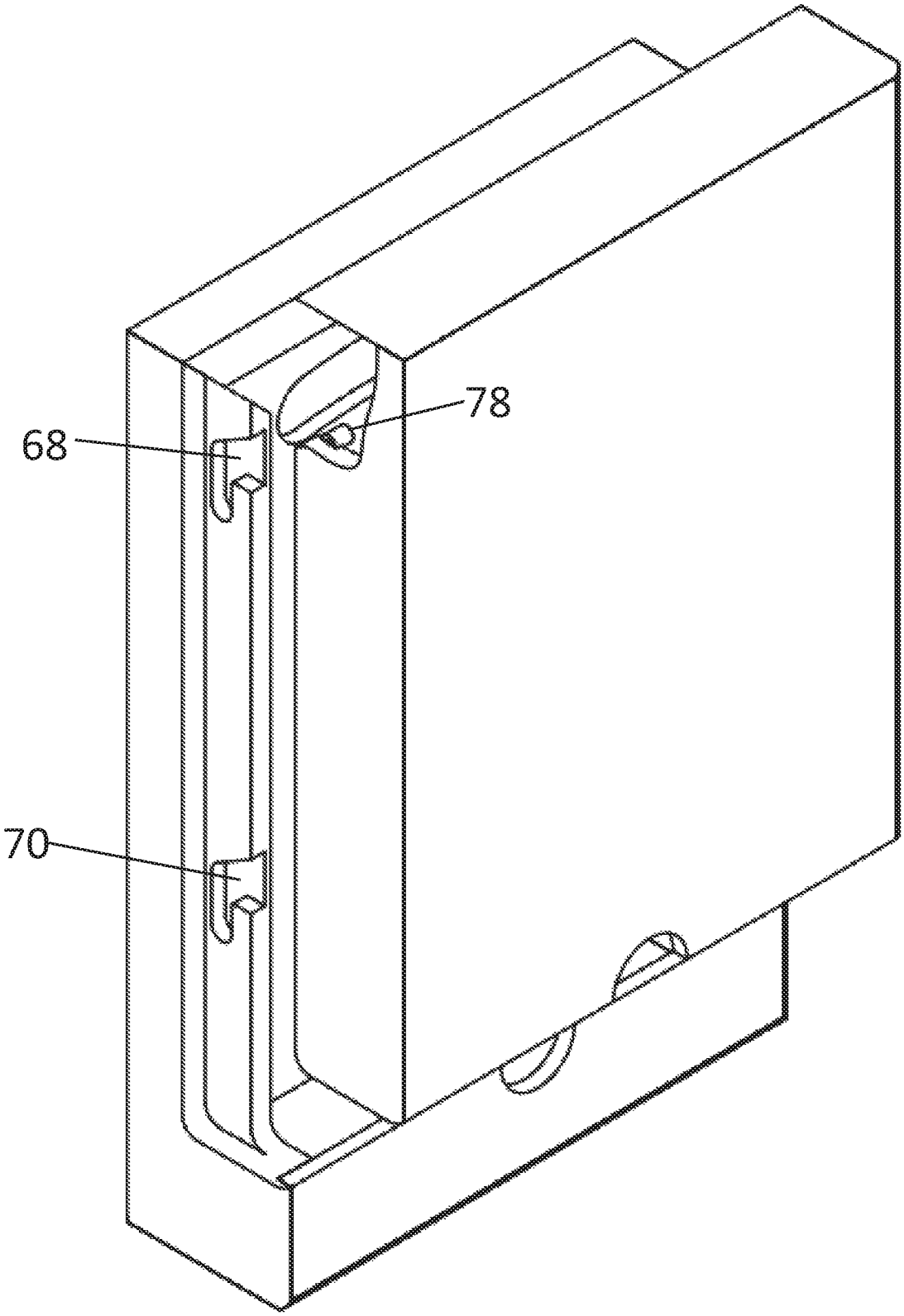
FIG. 7 shows a front perspective view of the fluid-dispensing bag holder of FIG. 3, in an open position, with a cut away portion to reveal a fastening element to secure a first housing member to a second housing member.
Figure 8:
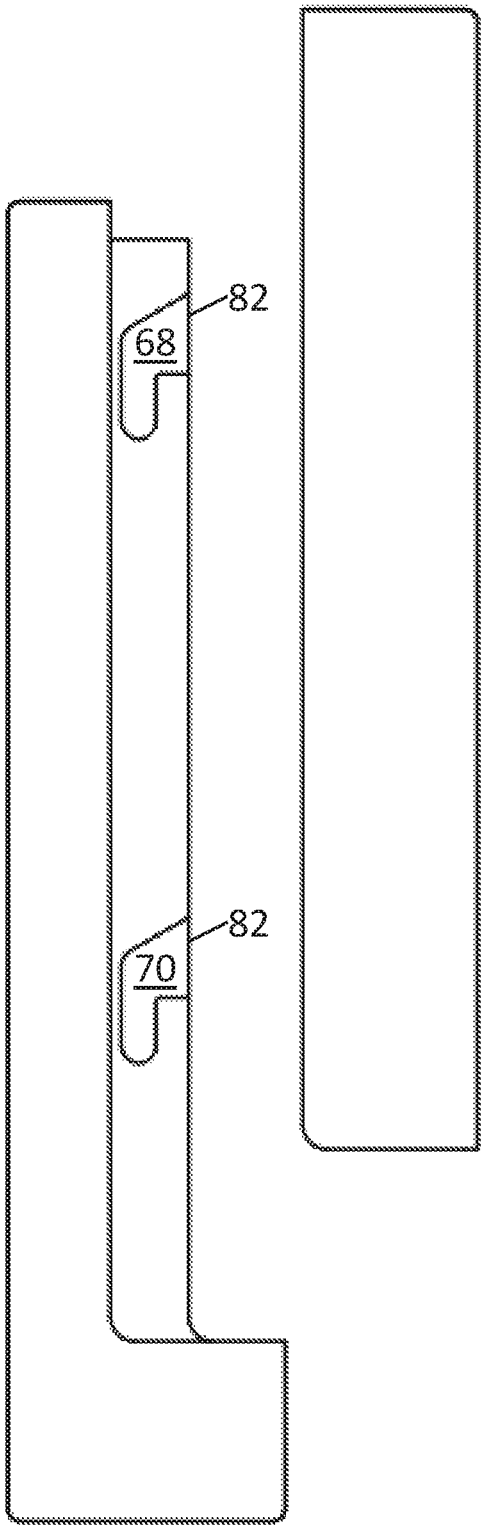
FIG. 8 shows a side view of the fluid-dispensing bag holder, in the open position of FIG. 7.

FIG. 7 shows a front perspective view of the fluid-dispensing bag holder 10, in an open position, with a cut away portion to reveal slot 68. FIG. 8 shows a side view of the fluid-dispensing bag holder 10, in the open position of FIG. 8, with the second housing member 14 ready to be moved into the closed position. Referring to FIGS. 5, 7, and 8, each of the first slot 64, the second slot 66, the third slot 68, and the fourth slot 70 extend in a first direction and a second direction, the first direction extending perpendicular to the second face 44 and/or the first wall 58, and the second direction extending parallel to the second face 44 and/or the second wall 60. The slots 64, 66, 68, 70 can be tapered to widen at a mouth 82. The widened mouth 82 can allow greater tolerance to align and engage the pins 74, 76, 78, 80 with the slots 64, 66, 68, 70. After engagement, the second housing member 14 can move toward and mate against the first housing member 12, after which the second housing member 14 can be slid into place against the first housing member 12, with the pins 74, 76, 78, 80 following the tracks of the slots 64, 66, 68, 70. In the closed position, the pins 74, 76, 78, 80 sit in the portion of the slots 64, 66, 68, 70 that extend in the second direction, which prevents the second housing member 14 from moving in any direction except one direction, and in a proper orientation for use, that one direction is upward, against gravity.

Figure 9:
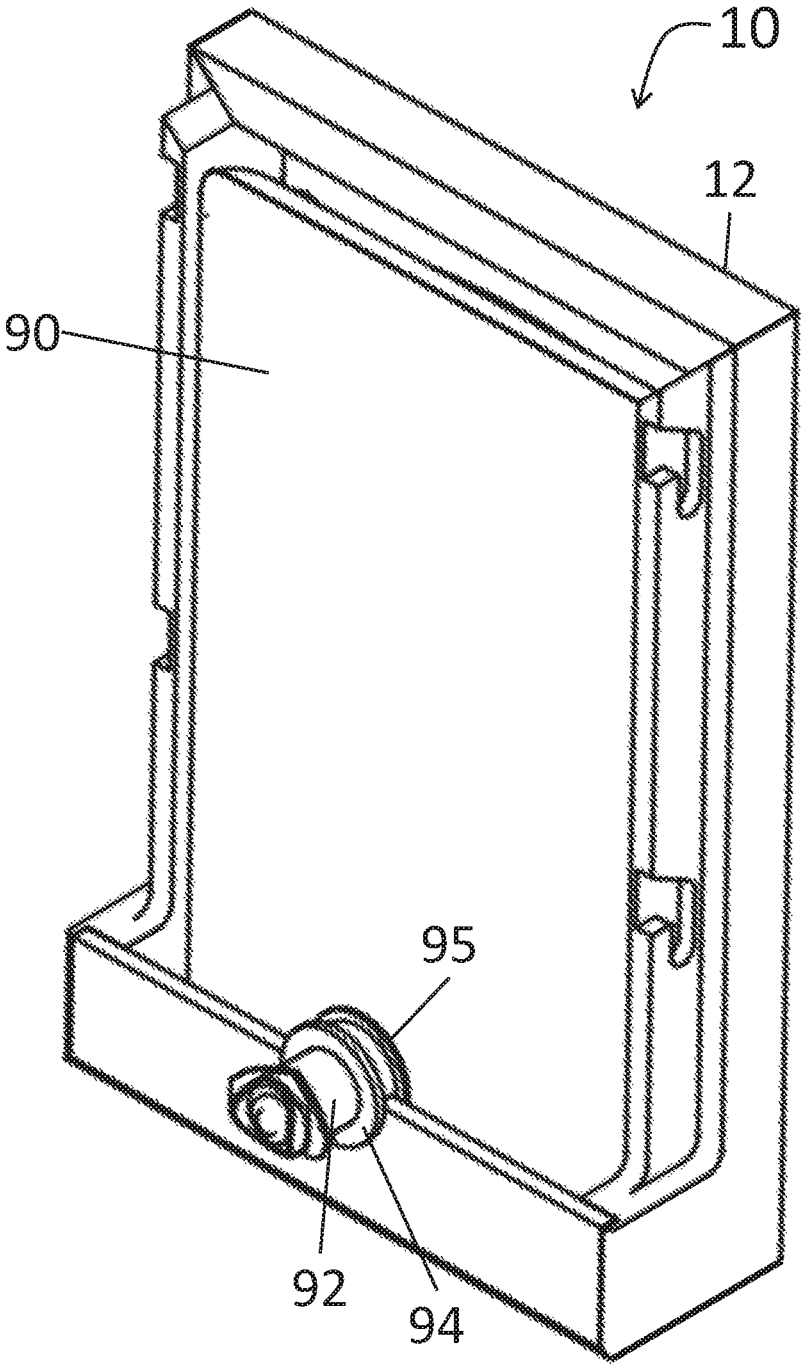
FIG. 9 shows a front perspective view of the fluid-dispensing bag holder of FIG. 3 in an open position without a second housing member and with a wine bag positioned in a first housing member.
Figure 10:
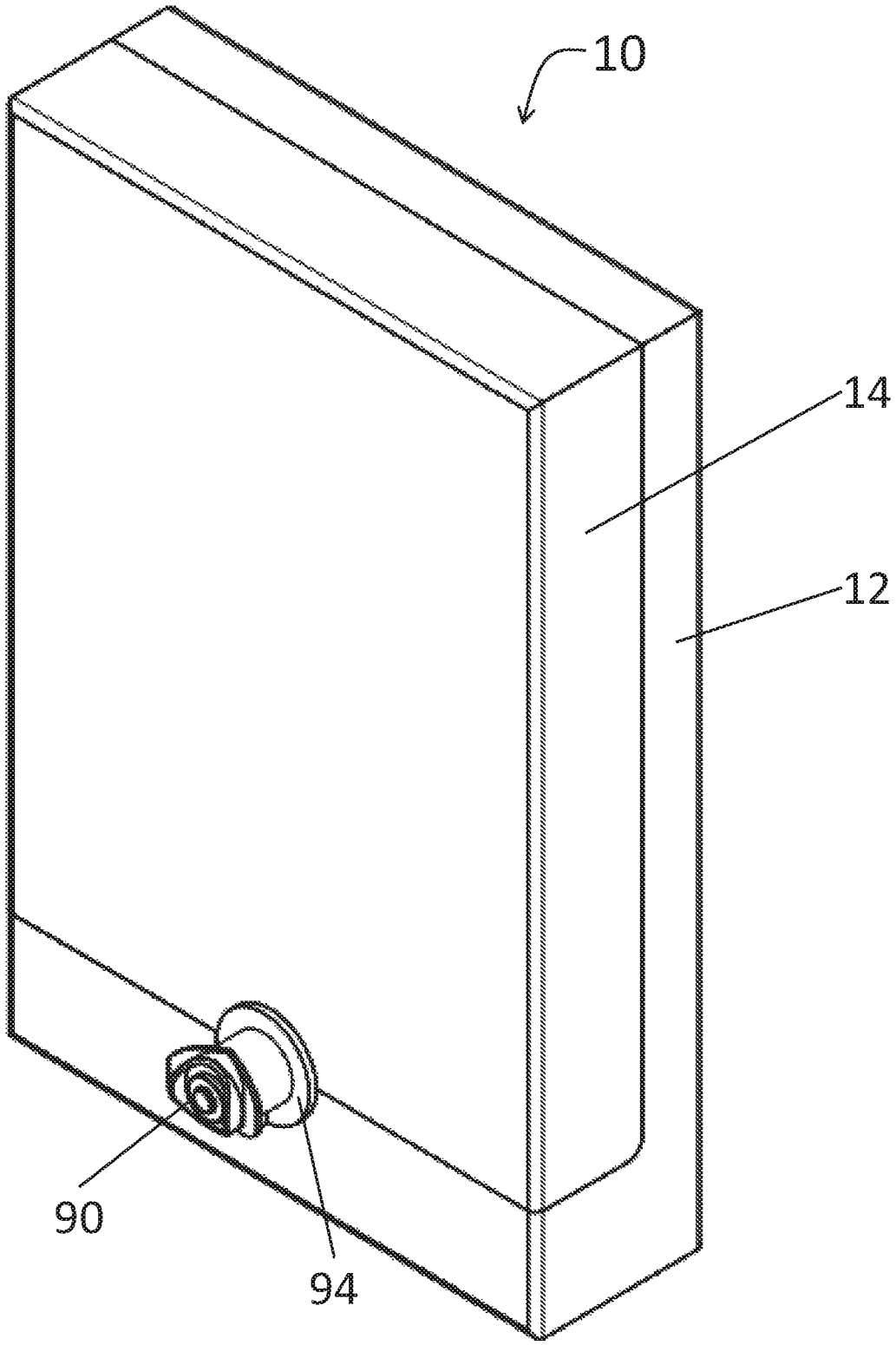
FIG. 10 shows a front perspective view of the fluid-dispensing bag holder of FIG. 3 in a closed position containing a wine bag.

FIG. 9 shows a front perspective view of the fluid-dispensing bag holder 10 in an open position without the second housing member 14 and with a wine bag 90 positioned in the first housing member 12. The wine bag 90 fits in the internal space 11, and a wine bag spout 92 is positioned in the first concavity 18 to extend out of the internal space 11. A portion of the wine bag spout 92 between a first retaining flange 94 and a second retaining flange 95 (each of which has a larger radius than the first concavity 18) straddles the first concavity 18 FIG. 10 shows a front perspective view of the fluid-dispensing bag holder 10 in a closed position containing the wine bag 90. When the second housing member 14 slides into a closed position, the second concavity 22 moves into position between the first retaining flange 94 and the second retaining flange, closing around the wine bag spout 92 with the first concavity 18. Because the spout hole 24 is smaller than the retaining flanges 94, 95, the wine bag spout is locked in place. Further, because the first housing member 12 and the second housing member 14 are each made of wood, hard plastic, metal, or another rigid and/or water-resistant material, and there are no flimsy, foldable, or movable flaps to alter the spout hole size, the fluid-dispensing bag holder 10 is less likely to be worn or damaged around the spout hole 24 and less likely to fail in operation.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A fluid-dispensing bag holder comprising:

a first housing member; and a second housing member;

the first housing member having a first edge with a first concavity, the second housing member having a second edge with a second concavity, the first housing member and the second housing member configured to be positioned in an open position and a closed position, the closed position including the first housing member mated with the second housing member to define a first wall and an internal space between the first housing member and the second housing member, and such that the first edge mates with the second edge and the first concavity aligns with the second concavity to define a spout opening through the first housing member and the second housing member into the internal space, the spout opening contained in the first wall, the first housing member having a first side and a second side, the first side having the first concavity, the second side defining a handle aligned on a plane of symmetry with the first concavity.

2. The fluid-dispensing bag holder of claim 1, wherein the spout opening has a diameter, and the diameter is smaller than a diameter of a retaining flange on a wine bag spout.

3. The fluid-dispensing bag holder of claim 1, wherein in the closed position the fluid-dispensing bag holder further comprises a width, a depth, a height, a first face defined by the width and the height, and a second face area defined by the depth and the height, the depth being smaller than the width and the height, the height being greater than the width and the depth, and the spout opening being located in the first face.

4. The fluid-dispensing bag holder of claim 1, further comprising a mounting element.

5. The fluid-dispensing bag holder of claim 4, wherein the mounting element is at least one mounting opening and the first housing member has a first side and a second side, the first side having the first concavity, the second side defining the at least one mounting opening.

6. The fluid-dispensing bag holder of claim 5, wherein the at least one mounting opening includes a first mounting opening and a second mounting opening, and wherein a line tangential to the first mounting opening and the second mounting opening is parallel with the first edge of the first housing member.

7. The fluid-dispensing bag holder of claim 6, wherein the second side further defines a handle opening, and wherein the line tangential to the first mounting opening and the second mounting opening is also tangential to the handle opening, the handle opening being larger than the first mounting opening and the second mounting opening.

8. The fluid-dispensing bag holder of claim 1, wherein the first housing member includes a first side, a second side intersecting the first side, a third side intersecting the first side, the third side opposite the second side, the first side, the second side, and the third side enclosing three sides of a first housing member cavity, the second side having a first slot and a second slot, the third side having a third slot and a fourth slot.

9. The fluid-dispensing bag holder of claim 8, wherein each of the first slot, the second slot, the third slot, and the fourth slot extend in a first direction and a second direction, the first direction extending perpendicular to the first side and the second direction extending parallel to the first side.

10. The fluid-dispensing bag holder of claim 8, wherein the second housing member includes a first side, a second side intersecting the first side, a third side intersecting the first side, the third side opposite the second side, the first side, the second side, and the third side enclosing three sides of a second housing member cavity, the second side having a first pin and a second pin, the third side having a third pin and a fourth pin, a distance between the first slot and the second slot the same as a distance between the first pin and the second pin, a distance between the third slot and the fourth slot the same as a distance between the third pin and the fourth pin.

11. The fluid-dispensing bag holder of claim 1 wherein the second housing member includes a first side, a second side intersecting the first side, a third side intersecting the first side, the third side opposite the second side, the first side, the second side, and the third side enclosing three sides of a second housing member cavity, the second side having a first pin and a second pin, the third side having a third pin and a fourth pin.

12. The fluid-dispensing bag holder of claim 11, wherein each of the first pin, the second pin, the third pin, and the fourth pin extend parallel to the first side.

13. A fluid-dispensing bag holder comprising:

a first housing member;

a second housing member, the first housing member and the second housing member movable between an open position and a closed position, the first housing member and the second housing member defining an internal cavity in the closed position;

a dispenser opening defined through one or more of the first housing member and the second housing member into the internal cavity; and a fastening element on at least one of the first housing member and the second housing member to secure the first housing member to the second housing member, the fastening element including a first slot on the first housing member, and a first pin on the second housing member, the first pin configured to be received by the first slot, the first slot having a first length and a second length, the first length and the second length each extending at a nonparallel angle to each other, wherein the first housing member includes a first side, a second side intersecting the first side, and a third side intersecting the first side, and the second housing member includes a fourth side, a fifth side intersecting the fourth side, and a sixth side intersecting the third side, the third side opposite the second side, the first side, the second side, and the third side enclosing three sides of a first housing member cavity, the sixth side opposite the fifth side, the fourth side, the fifth side, and the sixth side enclosing three sides of a second housing member cavity, the second side including the first slot, the fifth side including the first pin.

14. The fluid-dispensing bag holder of claim 13, wherein the fastening element further includes a second slot, a third slot, a fourth slot, a second pin, a third pin, and a fourth pin, the second pin configured to be received by the second slot, the third pin configured to be received by the third slot, the fourth pin configured to be received by the fourth slot.

15. The fluid-dispensing bag holder of claim 13, wherein the second side mates with the fifth side in the closed position, and the third side mates with the sixth side in the closed position.

16. A fluid-dispensing bag holder comprising:

a first housing member having a first edge with a first concavity; and a second housing member having a second edge with a second concavity, the first housing member and the second housing member configured to be positioned in an open position and a closed position, the closed position including the first housing member mated with the second housing member to define an internal space between the first housing member and the second housing member, and such that the first edge mates with the second edge and the first concavity aligns with the second concavity to define a spout opening through the first housing member and the second housing member into the internal space, the first housing member including a first side, a second side intersecting the first side, a third side intersecting the first side, and a first housing member cavity, the first housing member cavity including three sides, the third side opposite the second side, the first side, the second side, and the third side enclosing the three sides of the first housing member cavity, the second side having a first slot and a second slot, the third side having a third slot and a fourth slot.

17. The fluid-dispensing bag holder of claim 13, wherein in the closed position the fluid-dispensing bag holder further comprises a width, a depth, a height, a first face defined by the width and the height, and a second face defined by the depth and the height, the depth being smaller than the width and the height, the height being greater than the width and the depth, and the spout opening being located in the second face.

18. The fluid-dispensing bag holder of claim 16, wherein in the closed position the fluid-dispensing bag holder further comprises a width, a depth, a height, a first face defined by the width and the height, and a second face defined by the depth and the height, the depth being smaller than the width and the height, the height being greater than the width and the depth, and the spout opening being located in the second face.

* * * * *